US007757551B2

(12) United States Patent
Meister

(10) Patent No.: US 7,757,551 B2
(45) Date of Patent: Jul. 20, 2010

(54) METHOD AND APPARATUS FOR COLLECTING SUBTERRANEAN FORMATION FLUID

(75) Inventor: Matthias Meister, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 369 days.

(21) Appl. No.: 11/970,423

(22) Filed: Jan. 7, 2008

(65) Prior Publication Data

US 2008/0223125 A1 Sep. 18, 2008

Related U.S. Application Data

(60) Provisional application No. 60/894,721, filed on Mar. 14, 2007.

(51) Int. Cl.
*E21B 49/10* (2006.01)

(52) U.S. Cl. ..... 73/152.26; 73/152.25

(58) Field of Classification Search . 73/152.02–152.05, 73/152.18, 152.19, 152.21–152.29, 152.31
See application file for complete search history.

(56) References Cited

U.S. PATENT DOCUMENTS 3,079,793 A * 3/1963 Le Bus et al. ..... 73/152.26
3,530,933 A * 9/1970 Whitten ..... 166/100
3,565,169 A * 2/1971 Bell ..... 166/100
6,164,126 A * 12/2000 Ciglenec et al. ..... 73/152.01
6,301,959 B1 10/2001 Hrametz et al. ..... 73/152.23
6,581,455 B1 6/2003 Berger et al. ..... 73/152.55
6,585,045 B2 7/2003 Lee et al. ..... 166/252.5
6,640,908 B2 11/2003 Jones et al. ..... 175/50
6,719,049 B2 4/2004 Sherwood et al. ..... 166/264
2009/0283266 A1 * 11/2009 Nold et al. ..... 166/264

* cited by examiner

*Primary Examiner*—Hezron Williams
*Assistant Examiner*—Tamiko D Bellamy
(74) *Attorney, Agent, or Firm*—Cantor Colburn LLP

(57) ABSTRACT

An apparatus and method for collecting a fluid from a subterranean formation are disclosed. An elongated probe is coupled to a carrier, and the probe engages a borehole wall to form a seal therewith. The elongated probe has an inner wall defining a cavity within the elongated probe. A sleeve member extends axially through the cavity, the sleeve member having a fluid flow path within the sleeve member, the flow path being in fluid communication with the cavity. At least one fluid moving device is associated with the sleeve member and the cavity that urges fluid from the formation into the elongated probe. The fluid moving device operates on fluid entering the probe to control a first flow rate in the cavity and a second flow rate in the sleeve member flow path.

23 Claims, 6 Drawing Sheets

METHOD AND APPARATUS FOR COLLECTING SUBTERRANEAN FORMATION FLUID

CROSS-REFERENCE TO RELATED APPLICATIONS

The present application relates to and claims priority from U.S. Provisional application Ser. No. 60/894,721 of the same title filed on Mar. 14, 2007, the entire contents of which is hereby incorporated herein by reference.

BACKGROUND

1. Technical Field

The present disclosure generally relates to apparatuses and methods for evaluating formations traversed by a well borehole.

2. Background Information

In the oil and gas industry, formation testing tools have been used for monitoring formation pressures along a well borehole, obtaining formation fluid samples from the borehole and predicting performance of reservoirs around the borehole. Such formation testing tools typically contain an elongated body having an elastomeric packer and/or pad that is sealingly urged against a zone of interest in the borehole to collect formation fluid samples in fluid receiving chambers placed in the tool.

Downhole multi-tester instruments have been developed with extensible sampling probes for engaging the borehole wall at the formation of interest for withdrawing fluid samples from the formation and for measuring pressure. In downhole instruments of this nature an internal pump or piston may be used after engaging the borehole wall to reduce pressure at the instrument formation interface causing fluid to flow from the formation into the instrument.

SUMMARY

The following presents a general summary of several aspects of the disclosure in order to provide a basic understanding of at least some aspects of the disclosure. This summary is not an extensive overview of the disclosure. It is not intended to identify key or critical elements of the disclosure or to delineate the scope of the claims. The following summary merely presents some concepts of the disclosure in a general form as a prelude to the more detailed description that follows.

An apparatus for collecting a fluid from a subterranean formation is disclosed that includes a carrier conveyable into a borehole traversing the subterranean formation, an elongated probe coupled to the carrier that engages a borehole wall to form a seal therewith, the elongated probe having an inner wall defining a cavity within the elongated probe, a sleeve member extending axially through the cavity, the sleeve member having a fluid flow path within the sleeve member, the flow path being in fluid communication with the cavity, and at least one fluid moving device associated with the sleeve member and the cavity that urges fluid from the formation into the elongated probe, wherein the at least one fluid moving device operates on fluid entering the probe to control a first flow rate in the cavity and a second flow rate in the sleeve member flow path.

Another aspect disclosed is a system for collecting a fluid from a subterranean formation that includes a carrier conveyable into a borehole traversing the subterranean formation, an elongated probe coupled to the carrier that engages a borehole wall to form a seal therewith, the elongated probe having an inner wall defining a cavity within the elongated probe, a sleeve member extending axially through the cavity, the sleeve member having a fluid flow path within the sleeve member, the flow path being in fluid communication with the cavity, at least one fluid moving device associated with the sleeve member and the cavity that urges fluid from the formation into the elongated probe, wherein the at least one fluid moving device operates on fluid entering the probe to control a first flow rate in the cavity and a second flow rate in the sleeve member flow path, and a controller that controls the at least one fluid moving device.

A disclosed method for collecting a fluid from a subterranean formation includes conveying a carrier into a borehole traversing the subterranean formation, the carrier having an elongated probe coupled to the carrier the elongated probe having an inner wall defining a cavity within the elongated probe, the elongated probe further including a sleeve member extending axially through the cavity, the sleeve member having a fluid flow path within the sleeve member, engaging a borehole wall with the elongated probe to form a seal therewith, urging fluid from the formation into the elongated probe using at least one fluid moving device associated with the sleeve member and the cavity, communicating fluid between the flow path and the cavity, and controlling at least one of a first flow rate in the cavity and a second flow rate in the sleeve member flow path using the at least one fluid moving device.

BRIEF DESCRIPTION OF THE DRAWINGS

For detailed understanding of the present disclosure, references should be made to the following detailed description of the several embodiments, taken in conjunction with the accompanying drawings, in which like elements have been given like numerals and wherein.

DESCRIPTION OF EXEMPLARY EMBODIMENTS

Figure 1:
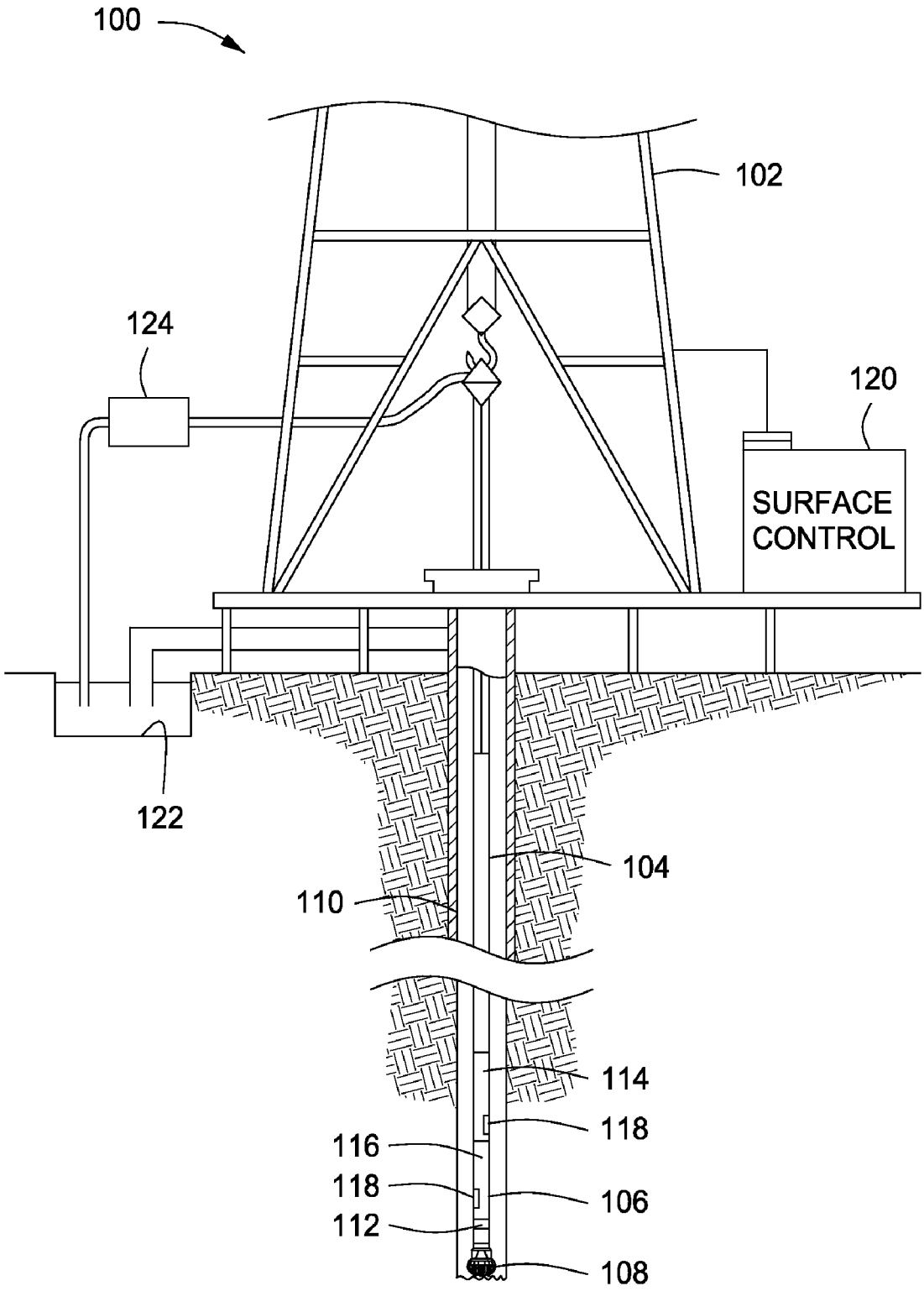
FIG. 1 illustrates a non-limiting example of a well drilling apparatus.

FIG. 1 schematically illustrates a non-limiting example of a drilling system 100 in a measurement-while-drilling (MWD) arrangement according to one embodiment of the disclosure. A derrick 102 supports a drill string 104, which may be a coiled tube or drill pipe. The drill string 104 may carry a bottom hole assembly (BHA) 106 and a drill bit 108 at a distal end of the drill string 104 for drilling a borehole 110 through earth formations.

Drilling operations according to several embodiments may include pumping drilling fluid or "mud" from a mud pit 122, and using a circulation system 124, circulating the mud through an inner bore of the drill string 104. The mud exits the drill string 104 at the drill bit 108 and returns to the surface through an annular space between the drill string 104 and inner wall of the borehole 110. The drilling fluid is designed to provide the hydrostatic pressure that is greater than the formation pressure to avoid blowouts. The pressurized drilling fluid may further be used to drive a drilling motor and may provide lubrication to various elements of the drill string.

In one non-limiting example, subs 114 and 116 may be positioned as desired along the drill string 104. As shown, a sub 116 may be included as part of the BHA 106. Each sub 114, 116 may include one or more components 118 adapted to provide formation tests while drilling ("FTWD") and/or functions relating to drilling parameters. The sub 114 may be used to obtain parameters of interest relating to the formation, the formation fluid, the drilling fluid, the drilling operations or any desired combination. Characteristics measured to obtain to the desired parameter of interest may include pressure, flow rate, resistivity, dielectric, temperature, optical properties, viscosity, density, chemical composition, pH, salinity, tool azimuth, tool inclination, drill bit rotation, weight on bit, etc. These characteristics may be processed by a processor (not shown) downhole to determine the desired parameter. Signals indicative of the parameter may then be transmitted to the surface via a transmitter 112. The transmitter 112 may be located in the BHA 106 or at another location on the drill string 104. These signals may also, or in the alternative, be stored downhole in a data storage device and may also be processed and used downhole for geosteering or for any other suitable downhole purpose. As used herein, the term parameter refers to the result of any useful measurement, calculation, estimation, or the like relating to drilling operations. For example, drilling parameters may include drilling speed, direction, weight on bit (WOB), mud characteristics (e.g. mud density, composition, etc. . . . ), torque, inclination and any other parameter relating to drilling. Other examples of parameters are formation parameters including rock type and composition, porosity, fluid composition produced from a formation, pressure, temperature, mobility, water content, gas content and other aspects of a subterranean formations and fluids produced from such formations. Obtaining these drilling and formation parameters provides useful information for further drilling operations and helps to determine the viability of a reservoir for producing hydrocarbons.

Many downhole operations include sampling formation fluid for testing. The samples obtained may be tested downhole using instruments carried by wireline, by the drill string, coiled tubing or wired pipe. Formation fluid samples may be brought to the surface for testing on-site or in a laboratory environment.

Figure 2:
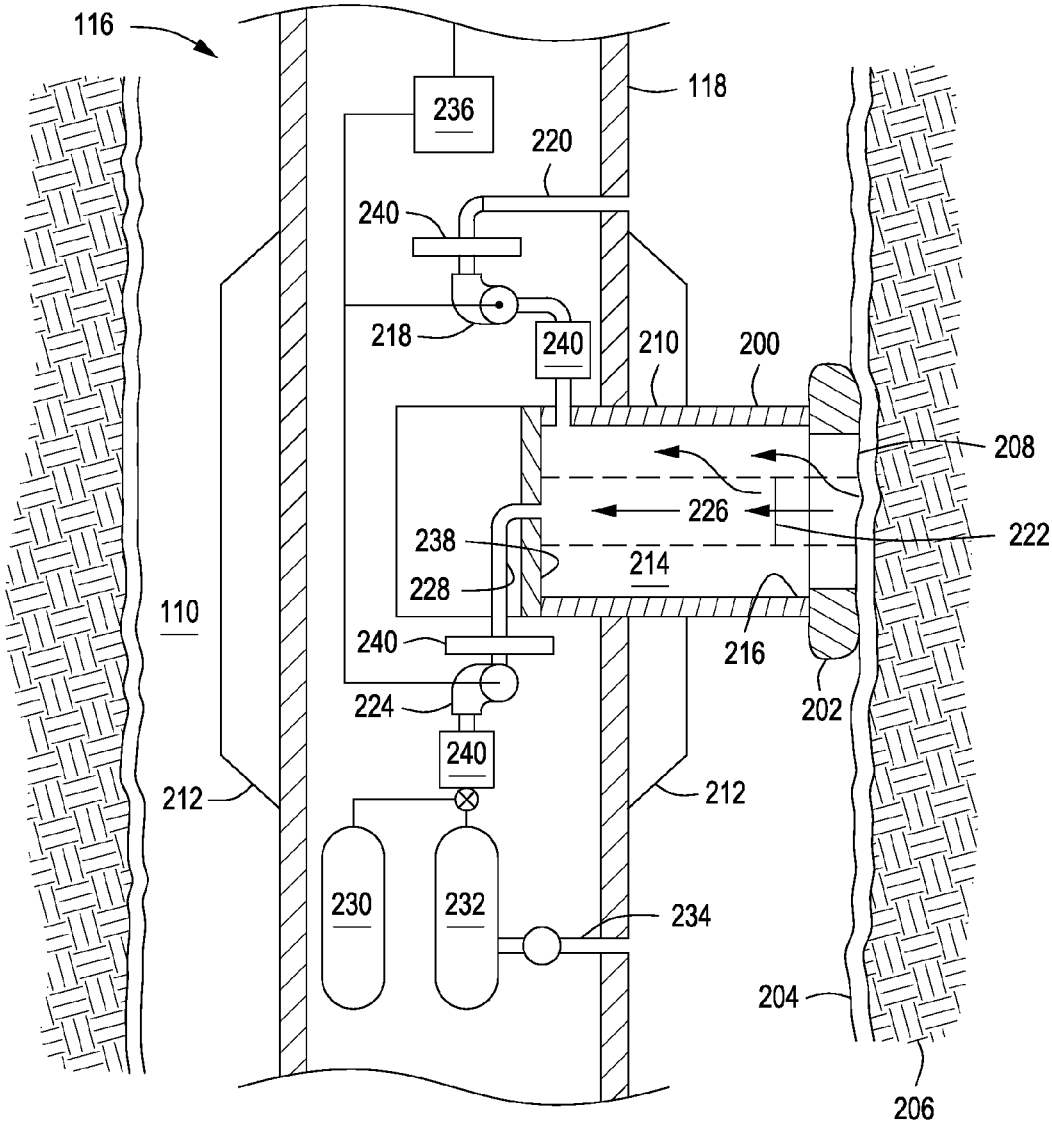
FIG. 2 is an elevation view that illustrates a non-limiting example of a downhole tool according to the disclosure.

Referring now to FIGS. 1 and 2, one non-limiting example of a sub 116 component 118 may include a fluid sampling probe 200 having a durable rubber pad 202 at a distal end of a probe body 210. The pad 202 may be mechanically pressed against the borehole wall 204 adjacent a formation 206 hard enough to form a hydraulic seal between the wall 204 and probe 200. The pad 202 includes an opening or port 208 leading to a chamber 214 formed by an inner wall 216 of the probe body 210. The pad 202 need not be rubber and may be constructed of any suitable material for forming a hydraulic seal. In some cases, the pad 202 may be eliminated and the probe end may form a seal with the borehole wall 204. A pump 218 may be used to reduce pressure within the cavity 214 to urge formation fluid into the port 208 and cavity 214. A flow line 220 may be used to convey fluid from the cavity 214 to the borehole annulus 110. In one non-limiting example, a fluid test and/or analysis device 240 may be used to determine type and content of fluid flowing in the flow line 220. The fluid test device 240 may be located on either side of the pump 218, or as shown, on both the inlet and outlet of the pump 218 as desired.

In one non-limiting example, a sleeve-like member, or simply sleeve, 222 is disposed within the cavity 214 and is in fluid communication with fluid entering the cavity 214. A second pump 224 may be used to control fluid pressure within the sleeve. A flow path 226 within the sleeve allows fluid to be conveyed from the sleeve flow path through flow lines 228, which may lead to a sampling chamber 230, to test chambers 232, and/or to a dump line 234 leading back to the borehole annulus. As used herein, the term sleeve means a member having a length, an outer cross-section perimeter and an inner cross-section perimeter creating a volume within the member. In the example of a cylindrical sleeve, the outer cross-section perimeter may be referred to as an outer diameter (OD) and the inner cross-section perimeter may be referred to as an inner diameter (ID). The term sleeve however, includes any useful cross-section shaped member that may not be circular as in the case of a cylinder, but may include shapes including eccentric. In one non-limiting example, a fluid test device and/or analysis 240 may be used to determine type and content of fluid flowing in the flow line 228. The fluid test device 240 may be located on either side of the pump 224, or as shown, on both the inlet and outlet of the pump 2224 as desired.

Each of the pumps 218, 224 may be independently controlled by one or more surface controllers, or by one or more downhole controllers 236 as shown. Fluid flow in the probe 200 according to several embodiments is controlled by controlling the flow rate in the cavity 214, the flow path 226, or both the cavity 214 and flow path 226 such that direction of fluid flowing in the cavity and the flow path may be controlled with respect to one another. In some cases, a flow rate may be selected for the cavity area and/or the flow path that urges at least some fluid flow from the flow path 226 to flow to the cavity 214 and on to the cavity pump 218. In other cases, a flow rate may be selected for the cavity area and/or the flow path that urges at least some fluid flow from the cavity 214 to the flow path 226 and on to the sleeve pump 224 for testing and/or storage.

In operation, the first pump may be used during initial sampling to generate a flow rate in the chamber flow path that is greater than the flow rate in the sleeve flow path 226 to help remove borehole fluid that may flow past the pad 208 seal. Once the fluid is relatively free of contamination by borehole fluid, the first pump rate of the first pump may be reduced or stopped to allow all or most of the clean fluid to be pumped by the second pump. In several non-limiting examples, the first pump 218 and second pump may be controlled to generate different flow rates. Generating different flow rates in the respective sleeve and cavity portion surrounding the sleeve will create a pressure gradient between the sleeve flow path and the cavity portion surrounding the flow path. The pressure gradient may have a vector of varying direction and magnitude, and the direction of pressure gradient may be generally from the cavity to the flow path or the gradient direction may be generally from the flow path to the cavity depending on the flow rates in the respective areas.

In the non-limiting example of FIG. 2, the probe 200 is shown mounted on the sub 116 at a centralizer 212. A centralizer is a member, usually metal, extending radialy from the sub 116 to help keep the sub 116 centered within the borehole. Other configurations of downhole tools may use ribs as centralizers or no centralizer at all. In some cases, a back-up shoe may be used to provide a counter force to help keep a probe pad 202 pressed against the borehole wall.

The probe 200 may be coupled to the sub 116 in a controllably extendable manner, such as is known in the art. In another example, the probe 200 may be mounted in a fixed position with an extendable rib or centralizer used to move the pad 202 toward the wall 204.

The inner sleeve-like member 222 may be of any number of sleeve types to allow fluid communication between the sleeve flow path 226 and cavity 214. In one example, the sleeve may be a solid cylinder-shaped sleeve that extends from a rear section 238 of the probe 200 toward the pad 202 port 208 and terminating in the cavity without extending all the way to the borehole wall 204. In this manner, fluid communication between the sleeve flow path and cavity is concentrated substantially near the sleeve terminating end within the cavity. In another non-limiting example, the sleeve-like member 222 may include several openings along the length of the sleeve or the front portion of the sleeve 222 to allow fluid communication between the sleeve flow path 226 and the cavity 214 as shown by the arrows extending from the flow path 226 to the cavity 214 in FIG. 2. In several embodiments including openings along the sleeve, the sleeve 222 may either terminate within the cavity 214 or the sleeve may extend to the borehole wall 204. Several non-limiting examples of sleeve configurations without and with openings are illustrated in FIGS. 3-7.

Figure 3:
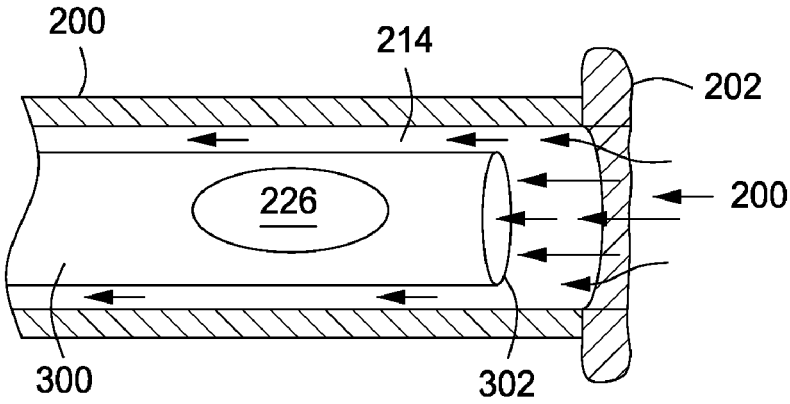
FIG. 3 illustrates a probe having a sleeve member that includes a solid wall.

FIG. 3 illustrates one non-limiting example of a sleeve-like member 300 disposed within a probe 200 cavity 214. The probe 200 is substantially as described above and shown in FIG. 2. The probe 200 includes a pad 202 having a port 208 leading to the cavity 214. The sleeve 300 may be constructed using any useful geometry. For illustration, the sleeve 300 is shown as being substantially cylindrical. Fluid and pressure communication between the sleeve 300 and cavity 214 is concentrated substantially at an end 302 of the sleeve 300 that terminates in the cavity 214. When a flow rate within the cavity 214 due to the pump, pump 218 of FIG. 2 for example, controlling flow from the cavity is greater than the flow rate within the flow path 226, then at least some of the formation fluid entering the port 208 will divert to the cavity around the sleeve 300.

In one example, the flow rate in the flow path 226 may be substantially zero, which may be the case during an initial stage of a fluid sampling operation. The flow rate in the flow path 226 may be increased to begin fluid flow in the flow path 226. In one example, the flow rate in the cavity may be decreased or stopped altogether to allow more fluid flow into the flow path 226. Such may be the case when substantially all the fluid entering the probe 200 is uncontaminated formation fluid. Those skilled in the art will appreciate that the flow of fluid may be controlled such that a desired flow through the cavity 214 and through the flow path 226 may be achieved by controlling the one or more pumps as described above.

Figure 4:
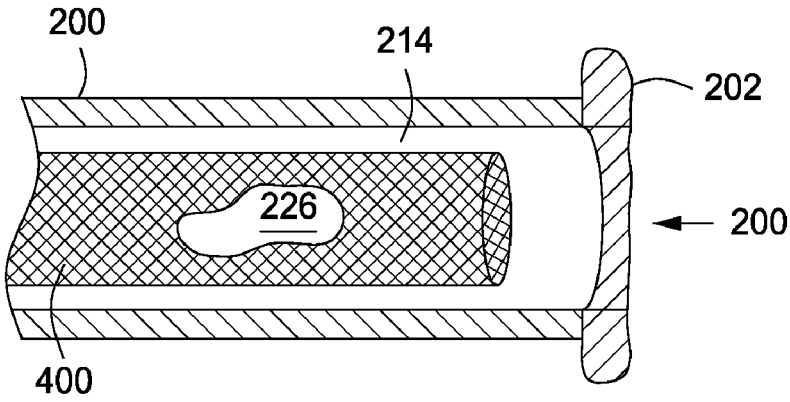
FIG. 4 illustrates a probe having a sleeve member that includes a wall with a screen-like structure.

FIG. 4 illustrates a non-limiting example of a sleeve-like member 400 disposed within a probe 200 cavity 214. The probe 200 is substantially as described above and shown in FIG. 2. The probe 200 includes a pad 202 having a port 208 leading to the cavity 214. The sleeve 400 may be constructed using any useful geometry. For illustration, the sleeve 400 is shown as being substantially cylindrical. Fluid and pressure communication between the sleeve 400 and cavity 214 is accomplished using openings along the length of the sleeve 400. In the non-limiting embodiment shown, the sleeve wall is constructed using a screen-like mesh that allows fluid and pressure communication between the flow path 226 and cavity 214.

When using a sleeve having a screen-like construction, the sleeve 400 may extend to the borehole wall and still provide pressure and fluid communication via the screen openings. The sleeve 400 may also terminate within the cavity 214 and not extend to the borehole wall. In either case, a flow rate within the cavity 214 due to the pump, pump 218 of FIG. 2 for example, controlling flow from the cavity is greater than the flow rate within the flow path 226, then at least some of the formation fluid entering the port 208 will divert to the cavity around the sleeve 400. In some cases the pump rate of pump 218 may be selected to be lower than the rate within the flow path 226.

Figure 5:
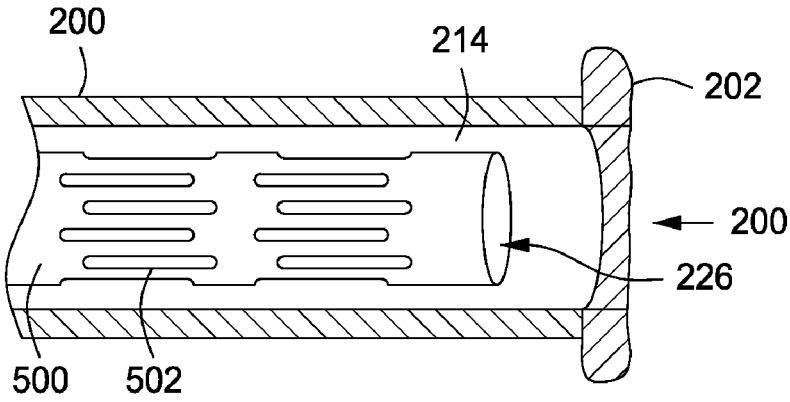
FIG. 5 illustrates a probe having a sleeve member that includes a wall with axial slots.

FIG. 5 illustrates a non-limiting example of a sleeve-like member 500 disposed within a probe 200 cavity 214. The probe 200 is substantially as described above and shown in FIG. 2. The probe 200 includes a pad 202 having a port 208 leading to the cavity 214. The sleeve 500 may be constructed using any useful geometry. For illustration, the sleeve 500 is shown as being substantially cylindrical. Fluid and pressure communication between the sleeve 500 and cavity 214 is accomplished using openings along the length of the sleeve 500. In the non-limiting embodiment shown, the sleeve wall is constructed using axial slots 502 that allow fluid and pressure communication between the flow path 226 and cavity 214.

When using a sleeve having axial slots 502, the sleeve 500 may extend to the borehole wall and still provide pressure and fluid communication via the screen openings. The sleeve 500 may also terminate within the cavity 214 and not extend to the borehole wall. In either case, a flow rate within the cavity 214 due to the pump, pump 218 of FIG. 2 for example, controlling flow from the cavity is greater than the flow rate within the flow path 226, then at least some of the formation fluid entering the port 208 will divert to the cavity around the sleeve 500.

Figure 6:
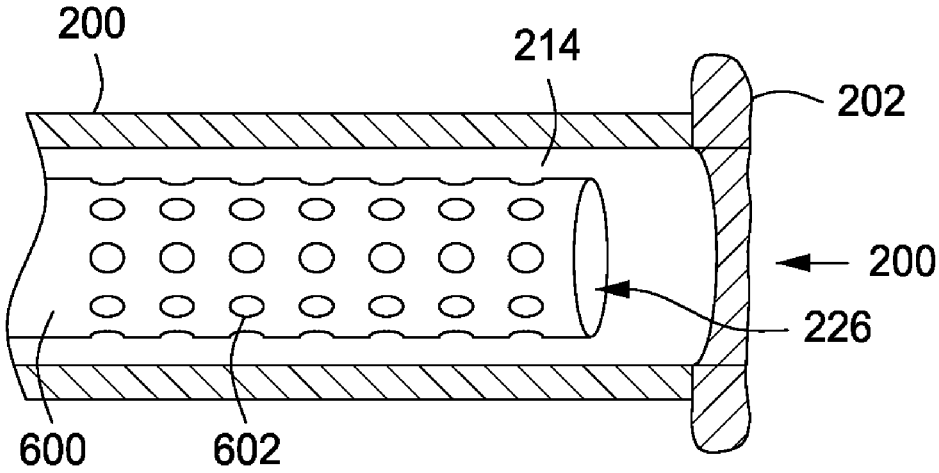
FIG. 6 illustrates a probe having a sleeve member that includes a wall with multiple holes formed therein.

FIG. 6 illustrates a non-limiting example of a sleeve-like member 600 disposed within a probe 200 cavity 214. The probe 200 is substantially as described above and shown in FIG. 2. The probe 200 includes a pad 202 having a port 208 leading to the cavity 214. The sleeve 600 may be constructed using any useful geometry. For illustration, the sleeve 600 is shown as being substantially cylindrical. Fluid and pressure communication between the sleeve 600 and cavity 214 is accomplished using openings along the length of the sleeve 600. In the non-limiting embodiment shown, the sleeve wall is constructed using holes 602 spaced along and around the sleeve 600 to allow fluid and pressure communication between the flow path 226 and cavity 214.

When using a sleeve having holes 602, the sleeve 600 may extend to the borehole wall and still provide pressure and fluid communication via the screen openings. The sleeve 600 may also terminate within the cavity 214 and not extend to the borehole wall. In either case, a flow rate within the cavity 214 due to the pump, pump 218 of FIG. 2 for example, controlling flow from the cavity is greater than the flow rate within the flow path 226, then at least some of the formation fluid entering the port 208 will divert to the cavity around the sleeve 600.

Figure 7:
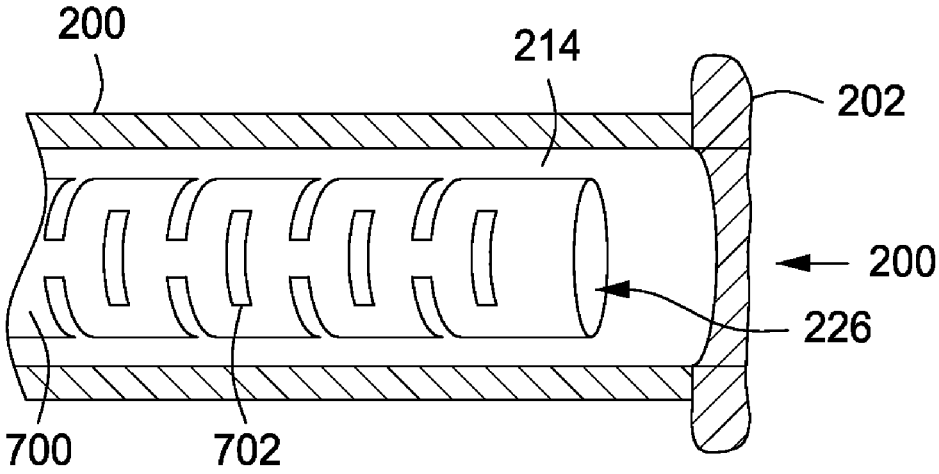
FIG. 7 illustrates a probe having a sleeve member that includes a wall with circumferential slots.

FIG. 7 illustrates a non-limiting example of a sleeve-like member 700 disposed within a probe 200 cavity 214. The probe 200 is substantially as described above and shown in FIG. 2. The probe 200 includes a pad 202 having a port 208 leading to the cavity 214. The sleeve 700 may be constructed using any useful geometry. For illustration, the sleeve 700 is shown as being substantially cylindrical. Fluid and pressure communication between the sleeve 700 and cavity 214 is accomplished using openings along the length of the sleeve 700. In the non-limiting embodiment shown, the sleeve wall is constructed using circumferential slots 602 that allow fluid and pressure communication between the flow path 226 and cavity 214.

When using a sleeve having circumferential slots 702, the sleeve 700 may extend to the borehole wall and still provide pressure and fluid communication via the circumferential slots 702. The sleeve 700 may also terminate within the cavity 214 and not extend to the borehole wall. In either case, a flow rate within the cavity 214 due to the pump, pump 218 of FIG. 2 for example, controlling flow from the cavity is greater than the flow rate within the flow path 226, then at least some of the formation fluid entering the port 208 will divert to the cavity around the sleeve 700.

In each of the several non-limiting examples of FIGS. 3-7, the flow rate in the flow path 226 may be substantially zero, which may be the case during an initial stage of a fluid sampling operation. The flow rate in the flow path 226 may be increased to begin fluid flow in the flow path 226. In one example, the flow rate in the cavity may be decreased or stopped altogether to allow more fluid flow into the flow path 226. Such may be the case when substantially all the fluid entering the probe 200 is uncontaminated formation fluid. Those skilled in the art will appreciate that the flow of fluid may be controlled such that a desired flow through the cavity 214 and through the flow path 226 may be achieved by controlling the one or more pumps as described above.

The several sleeve-like members described above and shown in FIGS. 3-7 provide at least two general configurations for collecting fluid. One disclosed general configuration includes a solid-walled sleeve and a second general configuration includes a porous sleeve. When using a solid-walled sleeve, a probe engaging a borehole wall includes a seal element to separate a probe port from the borehole fluids. A sleeve-like member positioned within the probe extends toward the borehole wall, but does not contact the borehole wall. A fluid chamber or cavity is created within the probe housing to receive fluids from the formation. One or more fluid transfer devices such as pumps or pistons are used to reduce pressure within the sleeve and within the annular region between the inner conduit and the probe interior wall. A pressure differential or gradient is generated such that fluid entering the probe fluid chamber may flow either into the sleeve or into the annular region. When using a flow rate in the cavity annular region that is higher than the flow rate in the sleeve, contaminated fluid from the borehole entering into the probe fluid chamber from around the seal will tend to flow directly to the annular region whereas fluid entering the probe fluid chamber from the formation will tend to flow toward and into the inner conduit. Once the fluid entering the probe is substantially free of contaminants, the flow rates may be respectively adjusted to allow most or all of the fluid entering the probe to be collected via the sleeve.

In the versions using a porous sleeve having openings along the sleeve wall, the sleeve positioned within the probe extends toward the borehole wall and sleeve may contact the borehole wall, because fluid communication is accomplished via the wall openings. One or more fluid transfer devices such as pumps or pistons are used to reduce pressure within the sleeve and within the annular region between the sleeve and the probe interior wall. A pressure differential is generated such that fluid entering the probe will tend to flow either into the sleeve or into the annular region. Contaminated fluid from the borehole entering into the probe from around the probe seal will tend to flow directly to the annular region whereas fluid entering the probe from the formation will tend to flow through the sleeve. The openings along the length of the sleeve allow fluid to flow from within the ported conduit to the annular region to help ensure the fluid flowing in the center of the probe is free of contaminants. Those skilled in the art will recognize that the annular region surrounding the sleeve may have a different cross section area than that of the flow path within the sleeve.

Figure 8:
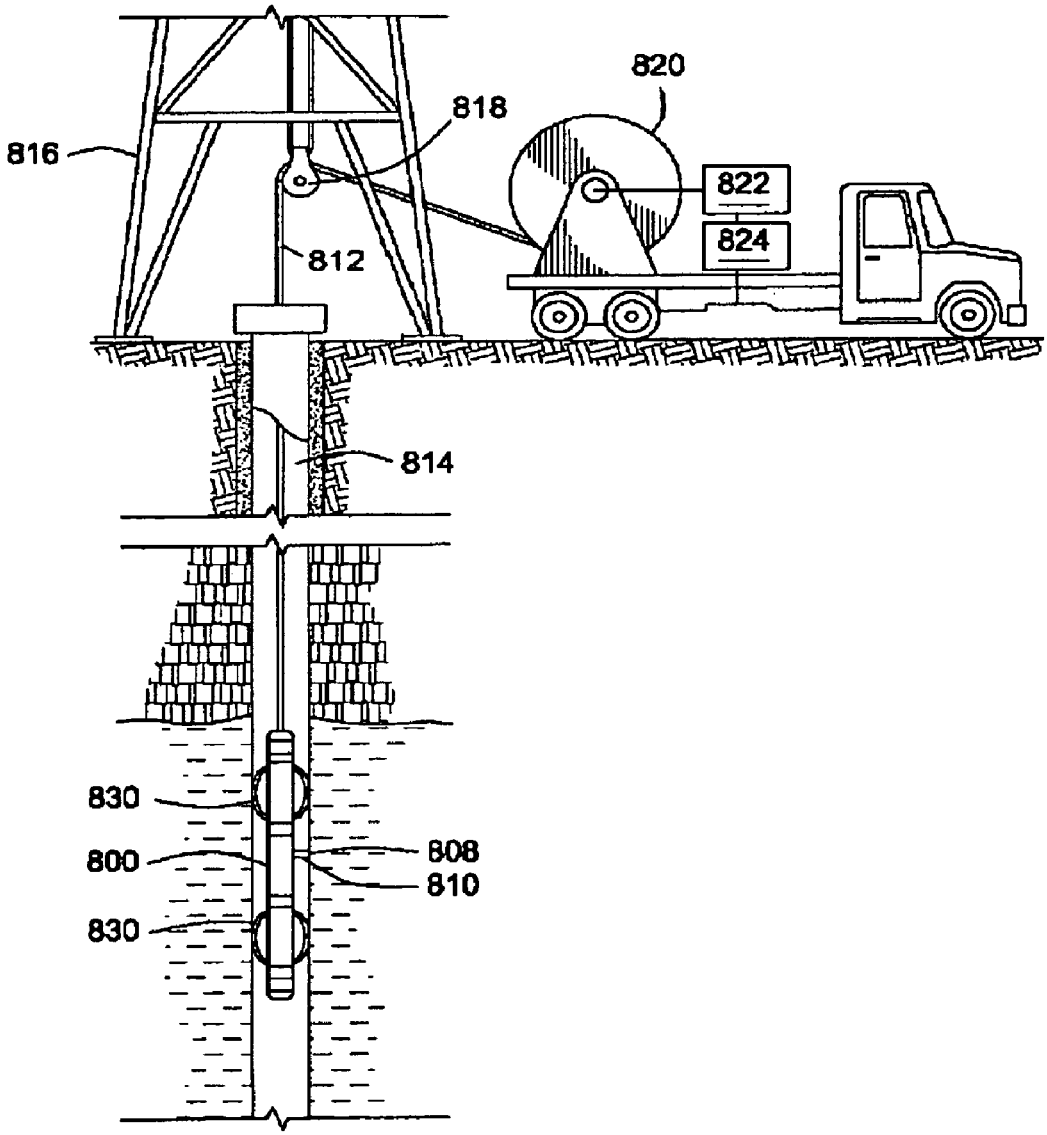
FIG. 8 illustrates a non-limiting example of a wireline apparatus.

The present disclosure is not limited to while-drilling embodiments. In FIG. 8 for example, a measuring tool 800 is shown disposed in a borehole 814 and supported by a wireline cable 812. As in the previously described embodiments, the tool 800 may be carried by wireline 812, by coiled tubing, by wired pipe or by any useful carrier. The tool 800 may be centralized in the borehole 814 centralizers 830. The cable 812 may be supported by a sheave wheel 818 disposed in a drilling rig 816 and may be wound on a drum 820 for lowering or raising the tool 800 in the borehole. The cable 812 may comprise a multi-strand cable having electrical conductors for carrying electrical signals and power from the surface to the tool 800 and for transmitting data measured by the tool to the surface for processing or for sending commands to the tool. The cable 812 may be interconnected to a telemetry interface circuit 822 and to a surface acquisition and control unit 824.

In the non-limiting example of FIG. 8, the wireline tool 800 may include an extendable probe 810 having a seal member or pad 808 at a distal end of the extendable probe. Such a probe may be similar to the probe 200 described above and shown in FIG. 2, and the tool 800 may be used to evaluate a subterranean formation in similar fashion as described above and shown in FIG. 1. In several embodiments, the probe 200 includes any one of the inner sleeve-like members described above and shown in FIGS. 2-7. The tool 800 may further include the controller 236, the pumps 218, 224, sample chamber 230 and test chamber 232 along with any other of the useful downhole components described above and shown in FIG. 2.

Figure 9:
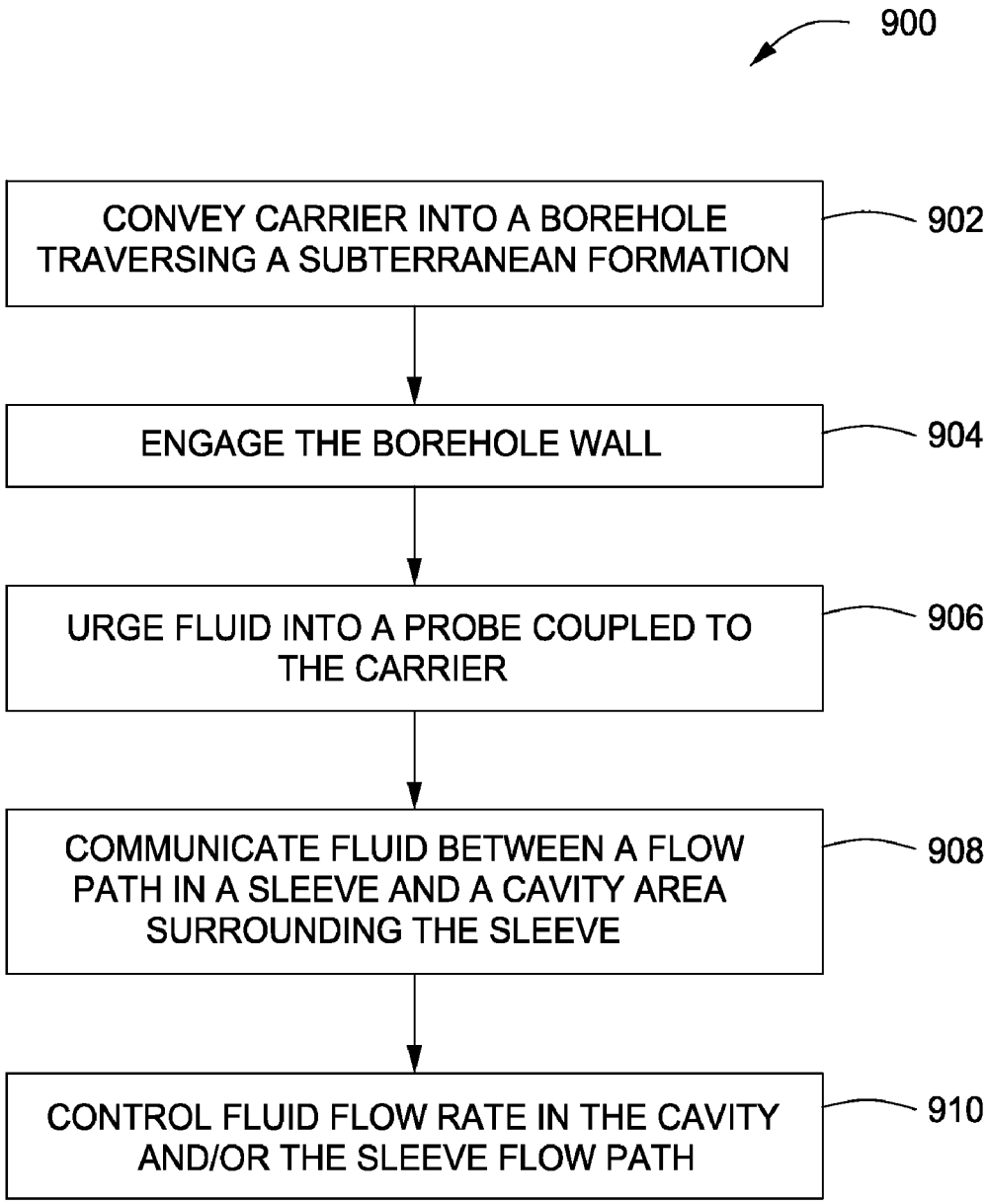
FIG. 9 illustrates a non-limiting example of a method for collecting a fluid from a subterranean formation.

FIG. 9 illustrates one example of a method 900 according to the disclosure. The method includes conveying a tool into a well borehole. The method 900 includes conveying a carrier into a borehole traversing the subterranean formation 902. The carrier may be an elongated probe coupled to the carrier, and the probe may be substantially similar to the probe 200 described above and shown in FIGS. 2-8. That is, the elongated probe includes an inner wall defining a cavity within the elongated probe and includes a sleeve member extending axially through the cavity, the sleeve member having a fluid flow path within the sleeve member. The method further includes engaging a borehole wall 904 with the elongated probe to form a seal therewith, and urging fluid from the formation into the elongated probe 906 using at least one fluid moving device associated with the sleeve member and the cavity. The method 900 further includes communicating fluid between the flow path and the cavity 908, and controlling at least one of a first flow rate in the cavity and a second flow rate in the sleeve member flow path 910 using the at least one fluid moving device.

In one example, the method may include controlling the first flow rate and second flow rate such that fluid flowing in the sleeve member flow path contains formation fluid substantially free of borehole fluid contamination.

In another non-limiting example, communicating fluid between the flow path and the cavity is accomplished using the sleeve member, wherein the sleeve member comprises a solid-wall, the sleeve member extending through the cavity and terminating with an opening at a distal end of the sleeve member, the open distal end being within the cavity. One such sleeve member is described above and shown in FIG. 3.

In several particular non-limiting examples, communicating fluid between the flow path and the cavity is accomplished using the sleeve member, wherein the sleeve member comprises a wall having openings to allow fluid and pressure communication between the flow path and the cavity via the openings. The openings may be a screen-like structure, axial slots, holes and/or circumferential slots. Example sleeve members with openings are described above and shown in FIGS. 4-7.

In one example method, controlling the first flow rate and second flow rate causes the first flow rate in the cavity and the second flow rate in the sleeve member flow path are different flow rates that create a fluid pressure gradient.

In another example, a first pump associated with the cavity and/or a second pump associated with the sleeve member flow path is/are controlled to cause a higher flow rate in a cavity portion surrounding the sleeve with respect to a flow rate in the flow path.

In yet another non-limiting example, a first pump associated with the cavity and/or a second pump associated with the sleeve member flow path is/are controlled to cause a higher flow rate in the flow path with respect to a flow rate in a cavity portion surrounding the sleeve.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Such insubstantial variations are to be considered within the scope of the claims below.

Given the above disclosure of general concepts and several particular embodiments, the scope of protection is defined by the claims appended hereto. The issued claims are not to be taken as limiting Applicant's right to claim disclosed, but not yet literally claimed subject matter by way of one or more further applications including those filed pursuant to the laws of the United States and/or international treaty.

What is claimed is:

1. An apparatus for collecting a fluid from a subterranean formation, the apparatus comprising:

a carrier conveyable into a borehole traversing the subterranean formation;

an elongated probe coupled to the carrier that engages a borehole wall to form a seal therewith, the elongated probe having an inner wall defining a cavity within the elongated probe;

a sleeve member extending axially through the cavity, the sleeve member having a fluid flow path within the sleeve member, the flow path being in fluid communication with the cavity; and at least one fluid moving device associated with the sleeve member and the cavity that urges fluid from the formation into the elongated probe, wherein the at least one fluid moving device operates on fluid entering the probe to control a first flow rate in the cavity and a second flow rate in the sleeve member flow path wherein the at least one fluid moving device comprises a first pump associated with the cavity and a second pump associated with the sleeve member flow path.

2. The apparatus of claim 1, wherein the at least one fluid moving device is operable such that fluid flowing in the sleeve member flow path contains formation fluid substantially free of borehole fluid contamination.

3. The apparatus of claim 1, wherein the sleeve member comprises a solid-wall, the sleeve member extending through the cavity and terminating with an opening at a distal end of the sleeve member, the open distal end being within the cavity.

4. The apparatus of claim 1, wherein the sleeve member comprises a wall having openings to allow fluid and pressure communication between the flow path and the cavity via the openings.

5. The apparatus of claim 4, wherein the openings comprise one or more of a screen-like structure, axial slots, a plurality of holes and circumferential slots.

6. The apparatus of claim 4, wherein the openings comprise a combination of at least two of a screen-like structure, axial slots, a plurality of holes, and circumferential slots.

7. The apparatus of claim 1, wherein the first flow rate in the cavity and the second flow rate in the sleeve member flow path are different flow rates that create a fluid pressure gradient.

8. The apparatus of claim 1, wherein at least one of the first pump and the second pump is controllable to provide a higher flow rate in a cavity portion surrounding the sleeve with respect to a flow rate in the flow path.

9. The apparatus of claim 1, wherein at least one of the first pump and the second pump is controllable to provide a higher flow rate in the flow path with respect to a flow rate in a cavity portion surrounding the sleeve.

10. A system for collecting a fluid from a subterranean formation, the system comprising:

a carrier conveyable into a borehole traversing the subterranean formation;

an elongated probe coupled to the carrier that engages a borehole wall to form a seal therewith, the elongated probe having an inner wall defining a cavity within the elongated probe;

a sleeve member extending axially through the cavity, the sleeve member having a fluid flow path within the sleeve member, the flow path being in fluid communication with the cavity;

at least one fluid moving device associated with the sleeve member and the cavity that urges fluid from the formation into the elongated probe, wherein the at least one fluid moving device operates on fluid entering the probe to control a first flow rate in the cavity and a second flow rate in the sleeve member flow path; and a controller that controls the at least one fluid moving device wherein the at least one fluid moving device comprises a first pump associated with the cavity and a second pump associated with the sleeve member flow path.

11. The system of claim 10, wherein the carrier is conveyable via one of i) a drill string, ii) a wireline, iii) a coiled tubing and iv) a wired pipe.

12. The system of claim 10, wherein the sleeve member comprises a solid-wall, the sleeve member extending through the cavity and terminating with an opening at a distal end of the sleeve-like member, the open distal end being within the cavity.

13. The system of claim 10, wherein the sleeve member comprises a wall having openings to allow fluid and pressure communication between the flow path and the cavity via the openings.

14. The system of claim 13, wherein the openings comprise one ore more of a screen-like structure, axial slots, a plurality of holes, and circumferential slots.

15. The system of claim 13, wherein the openings comprise a combination of at least two of a screen-like structure, axial slots, a plurality of holes, and circumferential slots.

16. A method for collecting a fluid from a subterranean formation, the system comprising:

conveying a carrier into a borehole traversing the subterranean formation, the carrier having an elongated probe coupled to the carrier the elongated probe having an inner wall defining a cavity within the elongated probe, the elongated probe further including a sleeve member extending axially through the cavity, the sleeve member having a fluid flow path within the sleeve member;

engaging a borehole wall with the elongated probe to form a seal therewith;

urging fluid from the formation into the elongated probe using at least one fluid moving device associated with the sleeve member and the cavity;

communicating fluid between the flow path and the cavity; and controlling at least one of a first flow rate in the cavity and a second flow rate in the sleeve member flow path using the at least one fluid moving device wherein the at least one fluid moving device comprises a first pump associated with the cavity and a second pump associated with the sleeve member flow path, wherein controlling at least one of the first flow rate and the second flow rate causes a higher flow rate in a cavity portion surrounding the sleeve with respect to a flow rate in the flow path.

17. The method of claim 16, wherein controlling the first flow rate and second flow rate includes controlling the flow rates such that fluid flowing in the sleeve member flow path contains formation fluid substantially free of borehole fluid contamination.

18. The method of claim 16, communicating fluid between the flow path and the cavity is accomplished using the sleeve member, wherein the sleeve member comprises a solid-wall, the sleeve member extending through the cavity and terminating with an opening at a distal end of the sleeve member, the open distal end being within the cavity.

19. The method of claim 16, communicating fluid between the flow path and the cavity is accomplished using the sleeve member, wherein the sleeve member comprises a wall having openings to allow fluid and pressure communication between the flow path and the cavity via the openings.

20. The method of claim 19, wherein the openings comprise one or more of a screen-like structure, axial slots, a plurality of holes, and circumferential slots.

21. The method of claim 19, wherein the openings comprise a combination of at least two of a screen-like structure, axial slots, a plurality of holes, and circumferential slots.

22. The method of claim 16, wherein controlling the first flow rate and second flow rate causes the first flow rate in the cavity and the second flow rate in the sleeve member flow path are different flow rates that create a fluid pressure gradient.

23. The method of claim 16, wherein the at least one fluid moving device comprises a first pump associated with the cavity and a second pump associated with the sleeve member flow path, wherein controlling at least one of the first flow rate and the second flow rate causes a higher flow rate in the flow path with respect to a flow rate in a cavity portion surrounding the sleeve.

* * * * *